US006142665A

United States Patent [19]

Haffner et al.

[11] Patent Number: 6,142,665

[45] Date of Patent: Nov. 7, 2000

[54] TEMPERATURE SENSOR ARRANGEMENT IN COMBINATION WITH A GAS TURBINE COMBUSTION CHAMBER

[75] Inventors: Ken-Yves Haffner; Matthias Höbel, both of Baden, Switzerland

[73] Assignee: ABB Alstom Power Ltd, Baden, Switzerland

[21] Appl. No.: 08/865,054

[22] Filed: May 29, 1997

[30] Foreign Application Priority Data

Jul. 18, 1996 [DE] Germany ..... 196 28 960

[51] Int. Cl.[7] ..... G01K 1/14

[52] U.S. Cl. ..... 374/144; 374/137; 374/147; 374/148; 60/39.33

[58] Field of Search ..... 374/137, 144, 374/161, 120, 124, 121, 141, 147, 148; 60/39.33

[56] References Cited

U.S. PATENT DOCUMENTS

| | | | |
|---|---|---|---|
| 4,865,416 | 9/1989 | Pratt | 385/12 |
| 5,361,586 | 11/1994 | McWhirter et al. | 60/737 |
| 5,384,467 | 1/1995 | Plimon et al. | 250/554 |
| 5,857,320 | 1/1999 | Amos et al. | 60/39.06 |

FOREIGN PATENT DOCUMENTS

| | | |
|---|---|---|
| 0325917 A2 | 8/1989 | European Pat. Off. . |
| 0593413A1 | 4/1994 | European Pat. Off. . |
| 4025852 A1 | 7/1991 | Germany . |
| 4025909 A1 | 7/1991 | Germany . |
| 299920A7 | 5/1992 | Germany . |
| 4137765A1 | 5/1993 | Germany . |
| 94 11 435 U | 12/1994 | Germany . |
| 4404577A1 | 8/1995 | Germany . |
| 61-290329 | 12/1986 | Japan . |
| 4-254726 | 9/1992 | Japan . |
| 2127174 | 4/1984 | United Kingdom . |
| 2192984 | 1/1988 | United Kingdom . |

*Primary Examiner*—Diego Gutierrez
*Assistant Examiner*—Stanley J. Pruchnic, Jr.
*Attorney, Agent, or Firm*—Burns, Doane, Swecker & Mathis, L.L.P.

[57] ABSTRACT

In a temperature-measuring device, in particular for measuring the flame temperature in a gas turbine combustion chamber, a number of optical measuring sensors (7) are arranged directly upstream of a flame front (8) in a premixing zone (3) of a burner (1). Each optical measuring sensor (7) is aligned essentially parallel to and/or coaxial with a fuel flow (5) directed into the gas turbine combustion chamber.

6 Claims, 1 Drawing Sheet

TEMPERATURE SENSOR ARRANGEMENT IN COMBINATION WITH A GAS TURBINE COMBUSTION CHAMBER

BACKGROUND OF THE INVENTION

1. Field of the Invention

The present invention relates to the field of combustion technology. It concerns a device for measuring flame temperature.

2. Background of the Invention

The determination of flame temperature has been attributed great importance since the start of research in the field of combustion technology. Flame temperature is a key parameter in the combustion of fossil fuels, since it is directly correlated with the chemical reaction kinetics and the formation of pollutants such as, for example, NOx. Moreover, knowledge of the release of energy during the combustion process is indispensable for the design of combustion chambers and determination of mechanical and the thermal loads of all components concerned.

At present, there are a multiplicity of techniques for measuring flame temperatures. However, the extreme operating conditions in this case represent a great challenge to the temperature sensors, with the result that it is not directly possible for every temperature sensor tested under clean laboratory conditions to be used in an industrial combustion chamber.

Broadly speaking, the temperature-measuring techniques commonly used today can be divided into two categories; non-optical temperature sensors are used in the first ones, and optical sensors are used in the others.

Point sensors, which comprise thermocouples, for example, belong to the non-optical temperature-measuring devices. They offer a simple and inexpensive possibility for determining temperature at discrete points, but they must be installed in the direct vicinity of the flame and therefore influence the flame. Furthermore, because of their fragility, thermocouples can be used only to a limited extent in a turbulent high-temperature environment in which, in addition, chemical surface reactions further impair the thermocouples.

Particularly since laser technology has become known, numerous optical temperature-measuring devices have been developed. These include, inter alia, absorption and fluorescence techniques as well as various measuring techniques employing scattered laser light. The said optical measuring methods have in common that they require a light source, a laser. They are thus of an active nature, but in contrast to the thermocouples they do not influence the flame. These methods deduce the temperature of a flame in conjunction with by taking account of the light emitted from the source and of the measuring volume.

A known optical, non-active temperature measurement is carried out by means of pyrometry, use being made of the blackbody radiation emitted by carbon black particles contained in the flame. However, it is a problem to apply pyrometric temperature-measuring systems to flames from gaseous fuels. The optical signal is very weak here because of the very low carbon black content. An additional difficulty in the signal analysis is that the temperature- and wavelength-dependent emissivity of the radiating carbon black particles is known only approximately, and, in conjunction with undesired absorption effects on the path to the detector, this impairs the accuracy of the method.

The installation of all known, optical temperature-measuring devices is performed at the smallest possible distance from a flame. For this purpose, the measuring sensors are arranged either at right angles to the flow direction of the fuel mixture next to the flame front in the combustion chamber, or they are located downstream of the burner in a front plate, the measuring sensors being aligned obliquely relative to the flame front.

It is particularly disadvantageous in the case of such an installation that, because of thermo-acoustic fluctuations in the combustion chamber, the flame does not burn at a fixed point but fluctuates in a region of the combustion chamber. A consequence of this is that the determination of the temperature using the measuring installation described is subject to error, since an individual flame plane cannot be continuously detected.

SUMMARY OF THE INVENTION

Accordingly, one object of the invention is to develop an optical temperature-measuring device of the type mentioned at the beginning to the effect that exact temperature measurement can be carried out without being influenced by combustion chamber pulsations, the aim being that the measuring sensor should allow quick measurement without impairing the flame and, moreover, that the measuring sensor is inexpensive and robust.

The essence of the invention is to be seen in that the optical measuring sensors, which are arranged directly upstream in the fuel stream and are aligned essentially parallel to and/or coaxial with the fuel stream, detect the entire flame front in the flow direction. In this case, the optical measuring sensors do not affect the flame and, at the same time, the optical temperature measurement remains unimpaired by local fluctuations in the flame owing to the thermo-acoustic compressive oscillations occurring in a gas turbine combustion chamber.

The advantages of the invention are to be seen, inter alia, in that during the operation of the gas turbine it is possible to perform exact optical measurement of the flame temperature independently of combustion chamber pulsation, since, given an aperture of the optical sensor which is selected to be of an appropriate size, the entire flame front is always detected despite the flame fluctuating in the flow direction.

It is particularly expedient if an optical measuring sensor is arranged coaxially in the fuel flow within the premixing zone of a burner, and a number of further optical measuring sensors are arranged in the burner wall parallel to the fuel flow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, which diagrammatically represent exemplary embodiments of the invention and wherein.

DESCRIPTION OF THE PREFERRED EMBODIMENTS

Figure 1:
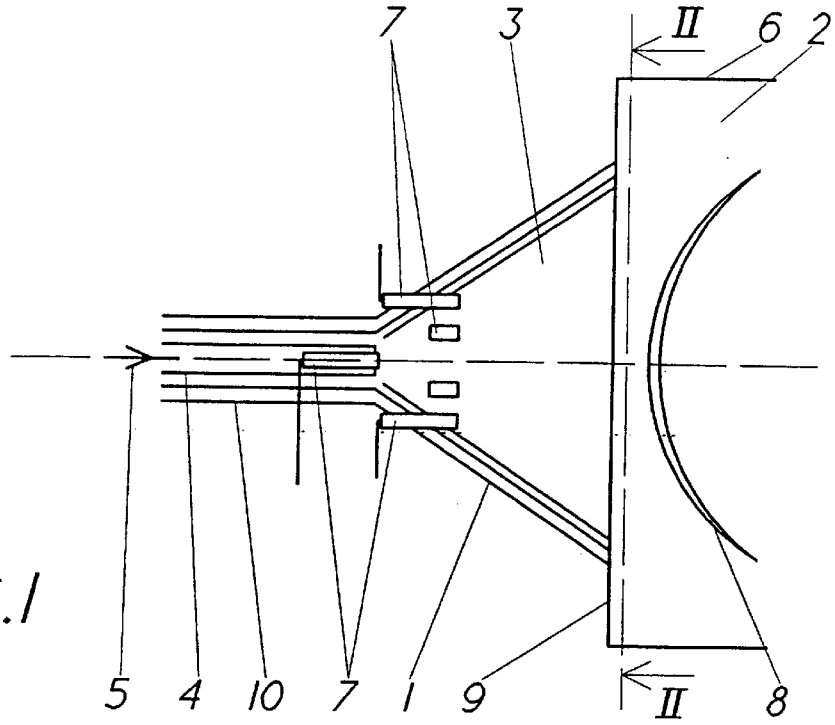
FIG. 1 shows a longitudinal section through a burner with an adjacent combustion chamber.

Referring now to the drawings, wherein like reference numerals designate identical or corresponding parts throughout the several views, only elements essential for understanding the invention being shown and there being no representation, for example, of the evaluation unit, connected to the measuring sensors, for determining the flame temperature from the detected optical signals. In FIG. 1 a conical burner such as is used in a gas turbine, for example, is denoted by 1. The burner 1 is supplied at one end with fuel via a fuel line 4 and with combustion air via an air line 10. Fuel and combustion air are fed through separate lines to the burner 1 in a flow direction 5, and the fuel and the combustion air are subsequently mixed with one another as uniformly as possible in a premixing zone 3. Downstream, the burner 1 terminates with a front plate 9. The front plate 9 is a component of a flame tube 2 which, furthermore, is bounded by a combustion chamber wall 6. A flame front 8 burns in the flame tube 2 downstream of the premixing zone 3.

For the purpose of optical temperature measurement, measuring sensors 7 are arranged in the burner 1 and in the fuel line 4 connected to it. The measuring sensors 7 are installed, on the one hand, in the premixing zone 3, essentially parallel to the flow direction 5 of the fuel or, on the other hand, are located in the center of the fuel line 4. The measuring sensors are all aligned toward the flame front 8. The numerical aperture of each measuring sensor 7 is selected so that a conical volume is sensed by each sensor 7, and the volume sensed is so large that the regions of the flame front which are relevant to the combustion process are sensed. To determine the temperature, the flame front 8 is observed from its inflow side by means of the measuring sensors 7. If the flame front 8 fluctuates because of thermoacoustic combustion chamber pulsations in a plane perpendicular to the flow direction 5, the optical temperature measurement remains largely uninfluenced thereby. This is because, despite the said fluctuations, the measuring sensors 7 always detect the entire flame front 8, or it is always the same flame section which is detected in accordance with the arrangement of a measuring sensor 7 installed in the premixing zone 3.

Figure 2:
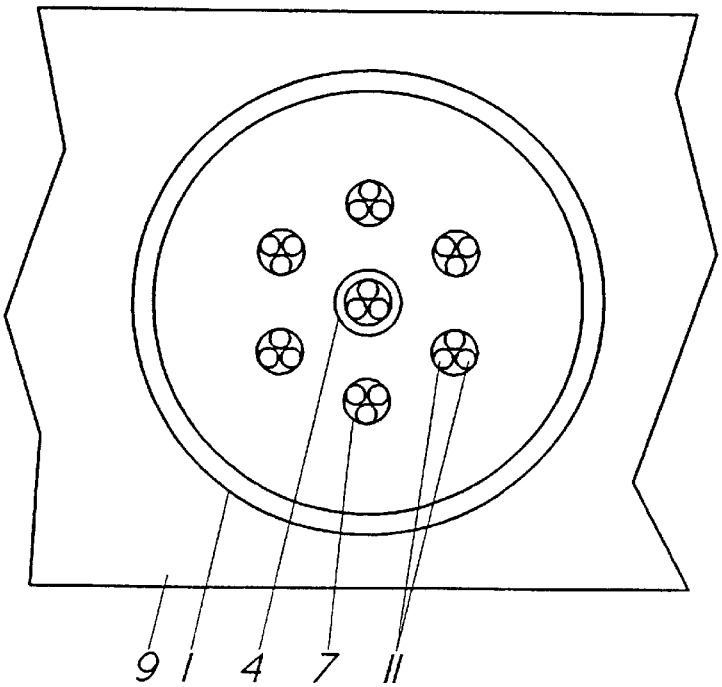
FIG. 2 shows a sectional representation of the burner in accordance with the line II—II in FIG. 1.

FIG. 2 shows the arrangement of the measuring sensors 7 in a sectional representation along the line II—II in FIG. 1. It is to be seen here that one measuring sensor 7 is arranged at the center of the fuel line 4, while six further measuring sensors 7 surround the fuel line 4 at a radial distance. In this arrangement, each measuring sensor 7 comprises a number of glass fibers 11, of which each functions as a measuring pickup. The number of installed measuring sensors 7 in one burner is, however, not important. Thus, it is conceivable according to the invention to arrange only one measuring sensor 7 at the center of the fuel line 4, this measuring sensor 7 being fitted with a glass fiber 11 or, for redundancy purposes, with a plurality of glass fibers 11. An exclusive solution with the measuring sensors 7 surrounding the fuel line 4 is therefore also conceivable. The number of measuring sensors 7 employed is, just like the number of glass fibers 11 arranged in them, to be made to match requirements.

The decisive installation criterion for the measuring sensors 7 is their arrangement directly upstream of the flame front 8. It is only in this position that optical temperature measurement can be carried out largely independently of possible flame movements and thus ensures the greatest possible stability of the sensor signals.

In order to evaluate the recorded signals, the measuring sensors 7 are connected, for example, to a suitable spectrometer (not represented here). Known methods can then be used to carry out a spectral analysis which permits an assignment between the spectral analysis and the flame temperature. Likewise, known absorption and fluorescence techniques can be applied to determine the flame temperature by means of the arrangement according to the invention.

Of course, the invention is not restricted to the exemplary embodiment shown and described. Thus, it is conceivable according to the invention to arrange the measuring sensors displaceably parallel to the flow direction in order to adjust them to the associated flame plane in the case of varying load points of the burner 1. Also conceivable for the same purpose is a device for setting the angle of inclination with respect to the burner axis for the measuring sensors 7 installed within the premixing zone.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by: Letters Patent of the United States is:

1. Apparatus for measuring the temperature of the flame front in a gas turbine combustion chamber, the apparatus comprising a burner having a central axis, conduit means for introducing fuel and air into the burner along the central axis of the burner, a gas turbine combustion chamber having a front plate, the burner having a premixing zone between the conduit means and the front plate, the front plate having an opening aligned with the central axis of the burner, and at least one optical measuring sensor aligned with the central axis, whereby the at least one sensor is exposed to the flame front through the front plate opening.

2. The temperature measuring apparatus as claimed in claim 1, wherein each measuring sensor includes a plurality of glass fibers which are combined to form a bundle.

3. The temperature measuring apparatus as claimed in claim 1, wherein a plurality of optical measuring sensors are arranged in the premixing zone.

4. The temperature measuring apparatus as claimed in claim 1, wherein the at least one optical measuring sensor is contained within the conduit means and is projecting into the premixing zone.

5. Apparatus for measuring the temperature of a flame burning in a gas turbine combustion chamber, comprising: a flame tube having a front plate, the front plate having an opening, premixing means for mixing a combustible mixture in a premixing zone having an inlet and an outlet, the outlet of the premixing zone being aligned with and encompassing the front plate opening, at least one optical measuring sensor being located adjacent the premixing zone inlet, conduit means for supplying fuel and air to the inlet of the premixing zone, the conduit means and the premixing zone and the flame tube being in axial alignment, the sensor being positioned to receive heat radiation from the flame front burning in the flame tube.

6. The apparatus according to claim 5 including a plurality of optical sensors adjacent the premixing zone inlet and positioned to receive radiation from at least the flame front through the opening in the front plate.

* * * * *